US005755268A

United States Patent [19]

Arndt et al.

[11] Patent Number: 5,755,268

[45] Date of Patent: May 26, 1998

[54] LOOM WARP TENSIONING DEVICE WITH TORQUE MOMENT COMPENSATION

[75] Inventors: Stefan Arndt; Horst Haeussler, both of Lindau, Germany

[73] Assignee: Lindauer DORNIER Gesellschaft mbH, Lindau, Germany

[21] Appl. No.: 723,532

[22] Filed: Sep. 30, 1996

[30] Foreign Application Priority Data

Oct. 13, 1995 [DE] Germany ..... 195 38 121.1

[51] Int. Cl.[6] ..... D03D 49/12

[52] U.S. Cl. ..... 139/115

[58] Field of Search ..... 139/115, 114

[56] References Cited

U.S. PATENT DOCUMENTS

| | | | |
|---|---|---|---|
| 3,395,736 | 8/1968 | Nishikawa | 139/115 |
| 5,090,453 | 2/1992 | Stacher et al. | 139/115 |
| 5,220,945 | 6/1993 | Vandeweghe et al. | 139/114 |
| 5,558,132 | 9/1996 | Haeussler et al. . | |
| 5,562,128 | 10/1996 | Haeussler et al. . | |

FOREIGN PATENT DOCUMENTS

| | | |
|---|---|---|
| 0109472 | 5/1984 | European Pat. Off. . |
| 0231726 | 8/1987 | European Pat. Off. . |
| 0396501 | 11/1990 | European Pat. Off. . |
| 0547003 | 6/1993 | European Pat. Off. . |
| 2009260 | 6/1979 | United Kingdom . |

*Primary Examiner*—Andy Falik

*Attorney, Agent, or Firm*—W. G. Fasse; W. F. Fasse

[57] ABSTRACT

A tensioning unit for breakage-prone or rupture-sensitive warp threads in a weaving loom is constructed to avoid a torque responsive characteristic that gently tension the warp threads. For this purpose the tensioning unit is equipped with a torque moment compensation arrangement for compensating non-symmetric loading of a smoothing roller (10). A hollow guide roller (11) carried on rigidly mounted levers (9) has mounted inside the guide roller a rotatable stabilizing shaft (18), which in turn is operatively connected to the smoothing roller (10) through plates (19), so that the smoothing roller itself is supported by spring-loaded levers (8).

9 Claims, 2 Drawing Sheets

LOOM WARP TENSIONING DEVICE WITH TORQUE MOMENT COMPENSATION

FIELD OF THE INVENTION

The invention relates to a tensioning device for a loom intended for weaving warp threads that have a low tensile strength and hence are rupture prone.

BACKGROUND INFORMATION

European Patent Publication EP 0,396,501 (Stacher et al.), published on Nov. 7, 1990, discloses a loom with an easy acting tensioning mechanism for the warp threads. Stacher et al. intend to gently tension sensitive warp threads with a tensioning mechanism or system that has an easy acting or easy going drive, but which shall also be suitable for weaving heavy fabrics. Additionally, the Stacher et al. tensioning system shall be very sensitive with regard to tensioning variations in the warp threads and/or with regard to positional changes in the loom drive system. The tensioning system shall sensitively react to these operating conditions. For this purpose Stacher et al. disclose an adjustment mechanism that comprises a push rod that is adjustable in its length and which is operatively connected to a drive that in turn derives its drive power from the main loom drive. The adjustment mechanism is effective on a spring that is connected with a drive shaft and that functions as a torsion rod. The drive shaft that is operatively connected with the torsion rod carries bearings distributed over the weaving width, and has a rotationally symmetrical smoothing or tensioning roller supported on these bearings.

European Patent Publication EP 0,109,472 (Pfarrwaller), published on May 30, 1984, discloses a warp tensioning mechanism in a loom. The tensioning mechanism also comprises a torsion spring rod operatively connected with a loom drive. The tensioning rod in turn is arranged in a support beam constructed as a hollow shaft which also supports the smoothing or tensioning roller.

It is a disadvantage of such conventional tensioning mechanisms that influence the warp tension that their construction requires a substantial effort and expense, not only in the initial manufacture and installation, but also in the disassembly and reassembly in case of a malfunction of the tensioning mechanism.

OBJECTS OF THE INVENTION

In view of the above it is the aim of the invention to achieve the following objects singly or in combination:

to provide an uncontrolled tensioning unit for breakage-prone or rupture-sensitive warp threads, which permits a simple tensioning of the warp threads;

to construct the smoothing roller and a deflecting idler roller or guide roller of such a tensioning arrangement as lightweight components which do not require a conventional support beam;

to loosely support the smoothing roller and the guide roller in such a tensioning arrangement;

to construct the tensioning mechanism or unit to enable a vertical and horizontal positioning with due regard to the weaving technical requirements; and to provide a tensioning arrangement which provides for a torque compensation therein if the smoothing roller is subjected to differing or asymmetrical loads, e.g. along its length.

SUMMARY OF THE INVENTION

The above objects have been achieved according to the invention in an uncontrolled warp tensioning apparatus for a loom, having a smoothing roller arranged across the loom width, spring elements for biasing the smoothing roller, a guide roller, and a mounting bracket at each loom side. The mounting brackets are substantially vertically and horizontally adjustable into a respective fixed or fixable but releasable position. The tensioning apparatus further has a cross-beam rigidly connected at each beam end to a respective one of the mounting brackets, at least two bearing brackets, plates or shields spaced from each other along a length of the cross-beam, a first support lever journalled to a free end of each bearing bracket, and a second support lever rigidly secured to the free end of each bearing plate. Each of the first and second support levers forms a bearing for loosely supporting the smoothing roller and the guide roller respectively. The tensioning apparatus further has a shaft lockably mounted in a fixed loom component and passing through the bearing brackets, wherein the shaft is angularly adjustable around its longitudinal axis when it is unlocked for the angular adjustment. The angularly adjustable shaft carries journal or pivot elements to which the above-mentioned spring elements are operatively secured. The spring elements provide an operative connection between the angularly adjustable shaft and each of the first levers. Furthermore, the tensioning apparatus includes torque moment compensating elements operatively interposed therein for avoiding any possible non-symmetric loading of the warp threads.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
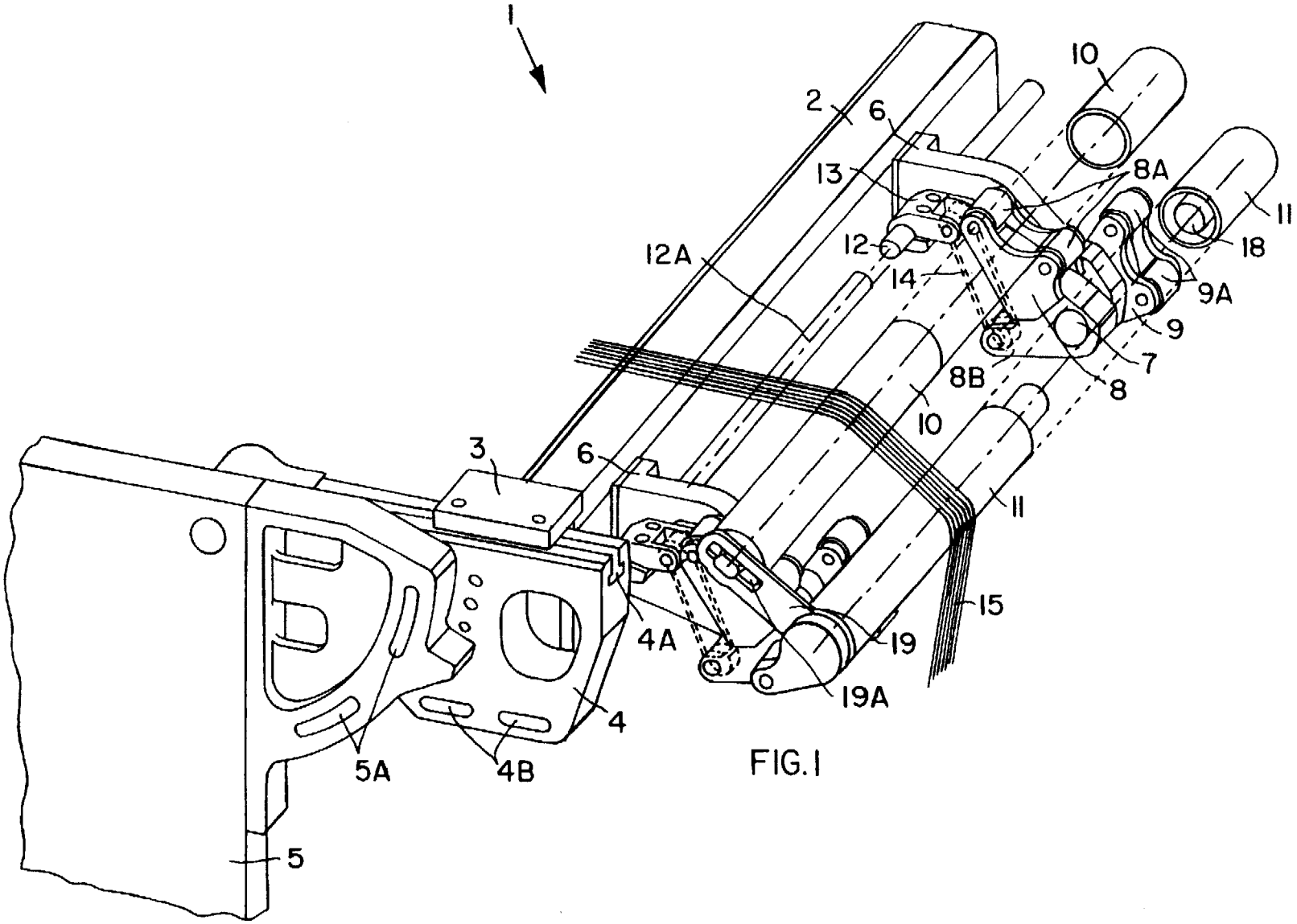
FIG. 1 shows a perspective view of the tensioning unit of the invention mounted on one loom side wall closer to the viewer, whereby the opposite loom side wall is not shown.

The tensioning device 1 comprises a cross-beam 2 which is connected to the loom frame by first and second mounting brackets 3, one of which is carried on each side of the loom frame. The bracket on the right-hand side of the loom is not visible in FIG. 1, however it is mirror-symmetrical to the bracket 3 on the left-hand side of the loom 3 seen in FIG. 1. The mounting brackets 3 are slidably adjustable in any suitable manner in or along a respective left-hand and right-hand support member 4 which in turn is secured to the respective loom side wall 5. More specifically, the support 4 is tiltably secured to the respective side wall 5. The sliding adjustment movement of the mounting brackets 3 and the tilting movement of the support members 4 permit a horizontal and a substantially vertical adjustment of the position of the mounting brackets 3 in the loom. Additionally, the support member 4 can be locked on the side wall 5 in an adjusted position by connecting elements (not shown) passing through elongated holes 5A and for example threading into threaded holes (not shown) provided in the side wall 5. Each support 4 is provided with a longitudinal groove 4A and elongated holes or slots 4B for connection with the respective mounting bracket 3. By means of the groove 4A and the elongated holes 4B, and connector element such as bolts (not shown), it is possible to position and secure the loom bracket 3 relative to the support 4 with the desired spacing to the loom shed forming and weaving components not shown in FIG. 1.

Several bearing brackets, plates or shields 6 are arranged along the length of the cross-beam 2. At least two outer bearing shields 6 are provided. All bearing shields 6 are arranged in a common mounting plane extending across the loom width. For example the vertical face of the crossbeam 2 to which the bearing shields 6 are secured may define such a common mounting plane. Each individual bearing shield 6 carries at its free end a first lever 8 mounted for tilting or rotating about a rotational axis 7, and parallel thereto a second lever 9 fixed against rotation. Both levers 8 and 9 form a roller bearing 8A, 9A. A smoothing roller 10 is loosely supported in the roller bearing 8A of the tiltably arranged lever 8. A guide roller 11 is loosely supported in the roller bearing 9A of the rigidly or non-rotatably mounted lever 9.

A shaft 12 is mounted in and passes through the bearing shields 6 in the area where the bearing shields 6 are connected to the cross-beam 2. The shaft 12 is rotatably adjustable about its longitudinal axis 12A. Alternatively, the shaft 12 may be supported in bearings and additionally connected to at least one of the bearing shields 6 in an arrestable or lockable manner.

Journal elements or pivot elements 13 are clamped to the circumference of the shaft 12 in positions corresponding to the positions of the tiltably mounted levers 8. Each journal or pivot element 13 is operatively connected to one end of a respective spring element 14. The other end of the respective spring element 14 is pivoted to a lever arm 8B of the lever 8. A force transmitting connection is provided between the adjustable shaft 12 and the respective lever 8 through the corresponding respective spring element 14.

By manually rotating or torquing the shaft 12 about its longitudinal axis 12A, all of the levers 8, and thus the smoothing roller 10, can be varied in their position since the smoothing roller 10 is supported in the roller bearings 8A carried by the lever 8. The tension of the smoothing roller 10 is thus adjustable in a very sensitive manner with due regard to the rupture prone characteristic of the warp threads forming the warp 15.

The tensioning device 1 further comprises a torque moment compensation arrangement for avoiding any possible non-symmetric loading of the warp 15. For this purpose there is provided according to the invention, as shown in detail in FIG. 2, an antifriction bearing such as a roller bearing 16 carrying first roller studs 10A, one of which is inserted into each of the two free ends of the smoothing roller 10. A roller bearing 17 is similarly integrated into the free ends of the guide roller 11. The roller bearing 17 supports in a rotatable manner a so-called stabilizing shaft 18 that passes through the hollow guide roller 11 without contacting the guide roller 11. The stabilizing shaft 18 has second journals 18A which are rotatably held in the roller bearings 17 of the stabilizing shaft 18.

Figure 2:
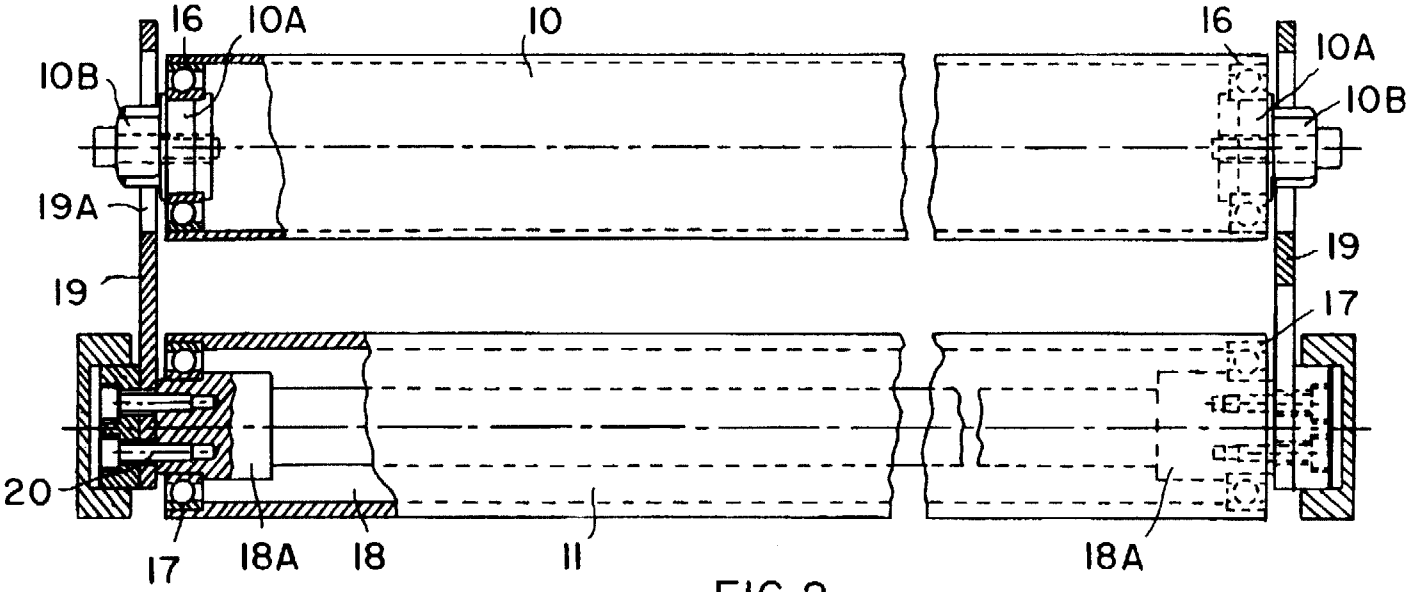
FIG. 2 schematically illustrates the features for compensating different torque moments within the tensioning unit.

Connecting plates 19 shown in FIG. 2 operatively connect the rotationally mounted stabilizing shaft 18 and the respective roller stud or journal pin 10A. The connection between the roller journal pin 10A and the plate 19 is so constructed that the plate 19 comprises a longitudinal guide 19A into which the roller journal pin 10A extends. The roller journal pin 10A comprises respective guide surfaces 10B for this purpose. On the other hand, a form-fit connection is provided between the respective shaft journal pins 18A and the plate 19, for example in the form of a screw connection 20. Such a construction ensures that a torque compensation is achieved in the tensioning device 1 by the stabilizing shaft 18 if there is an asymmetric or non-symmetric loading of the tension device 1.

Although the invention has been described with reference to specific example embodiments, it will be appreciated that it is intended to cover all modifications and equivalents within the scope of the appended claims.

What is claimed is:

1. A warp tensioning apparatus for a loom comprising a smoothing roller (10) arranged across the loom width, spring elements (14) for biasing said smoothing roller (10), a guide roller (11), a mounting bracket (3, 4) adapted to be positioned at each loom side, said mounting bracket being substantially vertically and horizontally adjustable into a fixed but releasable position, a cross-beam (2) rigidly connected at each beam end to a respective one of said mounting brackets (3, 4), at least two bearing shields (6) spaced from each other along a length of said cross-beam (2), a first support lever (8) journalled to a free end of each bearing shield (6), a second support lever (9) rigidly secured to said free end of each bearing shield (6), each of said first and second support levers (8, 9) forming a respective bearing (8A, 9A) for loosely supporting said smoothing roller (10) and said guide roller (11) respectively, a shaft (12) adapted to be lockably mounted in a fixed loom component and passing through said bearing shields (6), said shaft (12) being angularly adjustable around its longitudinal axis (12A), journals (13) carried by said angularly adjustable shaft (12), said spring elements (14) being operatively secured to said journals (13), said spring elements (14) providing an operative connection between said angularly adjustable shaft (12) and each of said first levers (8), and torque compensating elements (16, 17, 18, 18A, 19, 19A, 20) operatively interposed in said warp tensioning apparatus.

2. The apparatus of claim 1, wherein said bearings (8A, 9A) formed by said first and second support levers (8, 9) comprise slide or sleeve bearings.

3. The apparatus of claim 1, wherein said bearings (8A, 9A) formed by said first and second support levers (8, 9) comprise roller bearings.

4. The apparatus of claim 1, wherein said torque compensating elements comprise first journal studs (10A) in ends of said smoothing roller (10), a stabilizing roller (18) with second journal studs (18A) at its ends, and connector plates (19) operatively interconnecting said first and second journal studs (10A, 18A).

5. The apparatus of claim 4, wherein each of said connecting plates (19) comprises a longitudinal guide (19A) in which said first journal studs (10A) are adjustably supported, and wherein said second journal studs (18A) of said stabilizing roller (18) are rigidly mounted in said connecting plates (19).

6. The apparatus of claim 4, wherein said guide roller (11) is hollow and said stabilizing roller (18) extends through said hollow guide roller (11).

7. The apparatus of claim 6, further comprising bearings (17) mounting said guide roller (11) rotatably on said stabilizing roller (18).

8. The apparatus of claim 4, further comprising bearings (16) rotatably mounting said smoothing roller (10) on said first journal studs (10A).

9. The apparatus of claim 8, wherein said smoothing roller (10) is hollow.

* * * * *